US005746263A

United States Patent [19]

Koverola

[11] Patent Number: 5,746,263

[45] Date of Patent: May 5, 1998

[54] METHOD OF PRODUCING A WOODEN PACKAGE OR CONTAINER AND A WOODEN PACKAGE OR CONTAINER

[75] Inventor: Matti Koverola, Ristiina, Finland

[73] Assignee: Suomen Yrittäjäin Tuki R.Y., Ristiina, Finland

[21] Appl. No.: 717,910

[22] Filed: Sep. 23, 1996

[30] Foreign Application Priority Data

Sep. 21, 1995 [FI] Finland ..... 954478

[51] Int. Cl.[6] ..... B27F 1/00; B65D 88/00

[52] U.S. Cl. ..... 144/355; 53/471; 144/6.5; 144/7; 144/345; 144/363; 144/365; 144/355; 144/369; 144/380; 217/3 CB; 217/5

[58] Field of Search ..... 217/3 CB, 5, 12 R, 217/36, 13, 14, 65; 53/393, 471; 144/6.5, 7, 329, 345, 355, 363, 365, 369, 380, 367

[56] References Cited

U.S. PATENT DOCUMENTS 5,005,336 4/1991 Bloom ..... 53/471

*Primary Examiner*—W. Donald Bray
*Attorney, Agent, or Firm*—Kubovcik & Kubovcik

[57] ABSTRACT

The present invention concerns a method of producing a wooden package or container from an elongated piece of wood, e.g., a precut alder or birch piece (block). The invention is implemented by separating at least one essentially cylindrical, hollow blank (1) with the help of axial boring longitudinally from inside said block of wood, drying the blank and working its outer and inner surfaces by conventional wood-working techniques such as milling and turning to mutually concentric cylindrical surfaces of desired diameters, finishing said surfaces to desired smoothness by, e.g., sanding, and attaching to the cylindrical envelope piece thus obtained a bottom piece (2), and when required, also cover (3).

13 Claims, 1 Drawing Sheet

Figure 2:
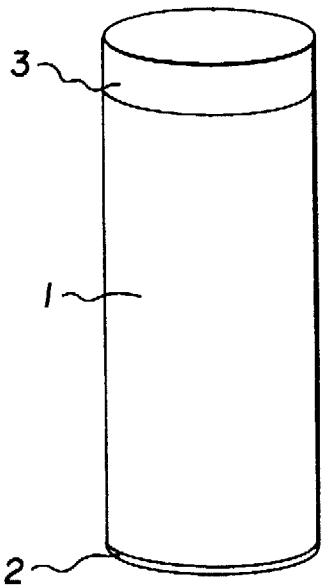

METHOD OF PRODUCING A WOODEN PACKAGE OR CONTAINER AND A WOODEN PACKAGE OR CONTAINER

The present invention relates to a method of producing a wooden package or container from an elongated piece of wood, e.g., a precut alder or birch piece (block).

Particularly, the present invention concerns such wooden packages that are suited for packaging, e.g., bottles. Today some product brands including valuable alcoholic beverages are sold packaged in wooden containers. Such wooden packages conventionally have a square cross section, requiring assembly from a number of separate pieces. Hence, their series production is hampered by high material and manufacturing costs. Additionally, assembled packages often lack the "aesthetic" finish required by their intended use. Therefore, they have not gained wider acceptance, at least not in this application. Obviously, high-quality wooden packages can be utilized in a plurality of applications. If not restricted by their high price, they would often be superior to plastic or glass packages in terms of reusability.

It is an object of the present invention to provide a method of producing a wooden package with significantly lower material and production costs than earlier possible in the art, said wooden package also featuring an exceptionally aesthetic look. The method according to the invention is characterized in that an essentially cylindrical, hollow blank is separated longitudinally from inside a crude block of wood by axial boring, the blank is dried and, using conventional wood-working techniques such as milling and turning, machined by its outer and inner surfaces to desired concentric diametrical dimensions, and said surfaces are finished to desired degree of smoothness by, e.g., sanding, and to such a finished piece is attached a bottom piece, and when required, also a cover.

An embodiment of the method according to the invention is characterized in that from inside a single block are separated by boring a plurality of concentric cylindrical blanks with different diameters.

Another embodiment of the method according to the invention is characterized in that the boring of a single cylindrical blank takes place in a single step using two concentric core bits of different diameters.

A still another embodiment of the method according to the invention is characterized in that the boring of a single cylindrical blank takes place in separate steps using two concentric core bits of different diameters.

It is still another object of the invention to provide a wooden package or container manufactured using any of the methods defined in annexed claims 1–4. The wooden package or container according to the invention is characterized in that the envelope of the wooden package or container is essentially cylindrical and is separated longitudinally from inside said block of wood by axial boring, whereby the cylindrical envelope is a single piece, and that to the bottom end of said cylindrical envelope is attached a bottom piece, and when required, a cover is attached to its upper end.

As mentioned above, the present invention has the benefit of offering the manufacture of wooden packages at low material and manufacturing costs, at a fraction of the costs of conventional wooden packages. This is because a single block of wood can be utilized for making a plurality of wooden packages with different diameters. Hence, the material losses are minimized. The production process itself is extremely simple using conventional wood-working techniques.

Figure 1:
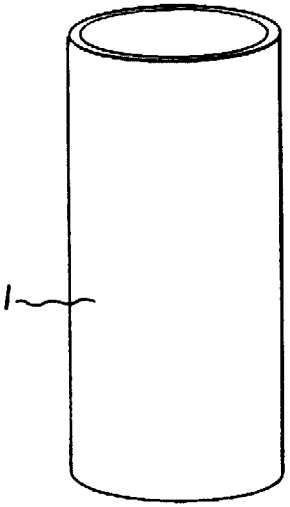

In the following, the invention is explained in greater detail with reference to the annexed drawings, in which FIG. 1 is a side view of an essentially cylindrical hollow envelope blank separated by boring from a block of wood; and FIG. 2 is a side view of the object of FIG. 1, now finished and complemented with a cover and a bottom piece.

Manufacture of a wooden package starts from a cut-to-length or arbitrary-length piece of wood (block), advantageously birch or alder, or other suitable species of wood. From this block a hollow, cylindrical, blank 1 having both ends open, which forms the envelope piece of the ready-made package is separated longitudinally by axial boring. Preferably, a wood species relatively free from knots and not prone to form cracks during drying should be selected. The separation of the blank by axial boring can be performed using two concentric core bits of different diameters either in a single step or in separate steps. Thus, it is possible to separate a plurality, even up to 20 pieces of hollow, cylindrical blanks of different diameters from a single block of wood depending on the diameter of the block.

Next, the cylindrical hollow blank is dried, typically in a drying process. As the boring finish on the outer and inner surfaces of the blank is relatively coarse, the inner surface of the blank is subsequently worked accurately circular to a specified inner diameter. After the outer surface is ground to calibrated dimension, the envelope of the package is ready-finished to desired outer and inner dimensions with an extremely high surface quality. If the block was not initially cut to length, the length trimming of the envelope can be made subsequently, prior to the following steps.

To the cylindrical envelope 1 is next attached a bottom piece 2, and when required, also a cover 3 (see FIG. 2). The bottom piece is usually fixed in a nondetachable manner. By contrast, the cover should be of a detachable type, advantageously permitting repeated opening. Hence, the circular bottom piece 2 can be attached by gluing either onto the bottom edge of the envelope, or alternatively, said bottom edge may have an inner shoulder worked thereto with a depth and diameter suited to accommodate flush-mounting and gluing or other fixing of the circular bottom piece 2 inside the envelope bottom. Respectively, the cover 3 can be implemented in a plurality of ways. In the diagram is shown a possible design in which the inserted cover forms a smooth extension of the cylindrical envelope with the same diameter. The top of the cover is typically solid. Alternative matching designs of the cover and the envelope are obviously possible. In most applications, easy detachment and reinsertion of the cover is required. As necessary, the cover may also be equipped with a suitable latching arrangement. Tight locking of the cover to the envelope may be implemented, e.g., by mounting inside the top of the envelope an annularly beaded, thin, cylindrical section, whose beaded upper rim extends above the rim of the envelope proper. The inner perimeter of the cover is then provided with a circular groove matching in depth and height the outer beaded rim of the section during snap-fit mounting of the cover on the envelope upper end. This type of cover is detached by pulling it directly upward, and respectively, is reinserted by pushing it straight from above onto the envelope end. The tolerances between the cover and the envelope top rim must be made so tight as to prevent the cover from inadvertently dropping off. However, the above-described design is only an exemplary alternative of fitting a cover to the envelope. Other-possible cover-envelope combinations are naturally feasible without departing from the scope of the invention.

To those versed in the art it is obvious that the invention is not limited by the exemplifying embodiments describe above, but rather, can be varied within the scope and spirit of the invention defined in the annexed claims. Accordingly, the surface of the package can be provided with different kinds of decorations and/or emblems as desired. The package may not necessarily need a cover, and it may alternatively be designed into a shallow container such as a bowl with a diameter greater than its height. After all cylindrical blanks have been separated by axial boring in the above fashion from inside a block of wood, usually also the hollow outer shell of the block with the bark still on it can be utilized by turning the shell into a cylinder and then working its inner surface in the earlier described manner.

I claim:

1. A method of producing a wooden package or container from an elongated block of wood, comprising:

providing an elongated block of wood;

axially boring said block of wood to produce at least one essentially cylindrical, hollow blank therefrom;

drying said at least one blank;

working the outer and inner surfaces of said at least one blank to provide mutually concentric cylindrical surfaces of desired diameters;

finishing said mutually concentric, cylindrical surfaces to a desired smoothness to obtain a cylindrical envelope piece; and attaching a bottom piece to said cylindrical envelope piece.

2. The method of claim 1 wherein said elongated block of wood is a precut alder block.

3. The method of claim 1 wherein said elongated block of wood is a precut birch block.

4. The method of claim 1 wherein a plurality of concentric cylindrical blanks are produced in said axially boring step.

5. The method of claim 1 wherein the axially boring of said block of wood is carried out in a single step using two concentric core bits of different diameters.

6. The method of claim 1 wherein the axially boring of said block of wood is carried out in separate steps using two concentric core bits of different diameters.

7. The method of claim 1 wherein the working of the outer and inner surfaces of said at least one blank is carried out by milling and turning.

8. The method of claim 1 wherein the finishing of said mutually concentric, cylindrical surfaces is carried out by sanding.

9. The method of claim 1 comprising the further step of attaching a cover to said cylindrical, envelope piece.

10. A wooden package or container comprising an elongated, cylindrical envelope having mutually concentric, cylindrical surfaces and which is a single piece of wood; and a bottom piece secured to one end of said cylindrical envelope.

11. The wooden container or package of claim 10 which is obtained by axially boring a precut alder block.

12. The wooden container or package of claim 10 which is obtained by axially boring a precut birch block.

13. The wooden container or package of claim 10 further comprising a cover detachably attached to an end of said cylindrical envelope opposite the end provided with said bottom piece.

* * * * *